US006336241B1

(12) United States Patent
Wilson

(10) Patent No.: US 6,336,241 B1
(45) Date of Patent: Jan. 8, 2002

(54) CLEANING DEVICE

(76) Inventor: Gary D. Wilson, P.O. Box 401, Clearfield, UT (US) 84089-0401

( * ) Notice: Subject to any disclaimer, the term of this patent is extended or adjusted under 35 U.S.C. 154(b) by 0 days.

(21) Appl. No.: 09/705,640

(22) Filed: Nov. 3, 2000

(51) Int. Cl.[7] ..... A47L 13/12; A46B 5/00
(52) U.S. Cl. ..... 15/144.2; 15/176.2
(58) Field of Search ..... 15/144.2, 176.2

(56) References Cited

U.S. PATENT DOCUMENTS

| | | | | | |
|---|---|---|---|---|---|
| 1,171,738 | A | * | 2/1916 | Mallet | 15/144.2 |
| 2,705,336 | A | | 4/1955 | Wilson | |
| 4,025,980 | A | * | 5/1977 | Neil | |
| 4,283,808 | A | * | 8/1981 | Beebe | 15/145 |
| 4,433,931 | A | | 2/1984 | Malish et al. | |
| 4,466,152 | A | | 8/1984 | Moss et al. | |
| D356,444 | S | | 3/1995 | Marshall | |
| 5,502,862 | A | | 4/1996 | Vosbikian | |
| 5,551,115 | A | | 9/1996 | Newville | |
| 5,778,479 | A | * | 7/1998 | Raia | 15/176.2 |

FOREIGN PATENT DOCUMENTS

| | | | | |
|---|---|---|---|---|
| CA | 1124213 | * | 5/1982 | 15/145 |
| DE | 3004708 | * | 8/1980 | 15/145 |

* cited by examiner

*Primary Examiner*—Randall E. Chin

(57) ABSTRACT

A cleaning device for cleaning a number of hard to reach places with less difficulty. The cleaning device includes a cleaning device that comprises a handle member. The handle member comprises an elongated shaft that includes a first end and a second end. The handle member also includes threads positioned adjacent to the first end. The inventive device also includes plurality of heads. Each of the heads is removably coupled to the threads of the handle member.

11 Claims, 2 Drawing Sheets

CLEANING DEVICE

BACKGROUND OF THE INVENTION

1. Field of the Invention

The present invention relates to cleaning devices and more particularly pertains to a new cleaning device for cleaning a number of hard to reach places with less difficulty.

2. Description of the Prior Art

The use of cleaning devices is known in the prior art. More specifically, cleaning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,466,152; 4,433,931; 5,551,115; 5,502,862; 2,705,336; and U.S. Pat. No. Des. 356,444.

While these devices fulfill their respective, particular objectives and requirements, the aforementioned patents do not disclose a new cleaning device. The inventive device includes a cleaning device that comprises a handle member. The handle member comprises an elongated shaft that includes a first end and a second end. The handle member also includes threads positioned adjacent to the first end. The inventive device also includes plurality of heads. Each of the heads is removably coupled to the threads of the handle member.

In these respects, the cleaning device according to the present invention substantially departs from the conventional concepts and designs of the prior art, and in so doing provides an apparatus primarily developed for the purpose of cleaning a number of hard to reach places with less difficulty.

SUMMARY OF THE INVENTION

In view of the foregoing disadvantages inherent in the known types of cleaning devices now present in the prior art, the present invention provides a new cleaning device construction wherein the same can be utilized for cleaning a number of hard to reach places with less difficulty.

The general purpose of the present invention, which will be described subsequently in greater detail, is to provide a new cleaning device apparatus and method which has many of the advantages of the cleaning devices mentioned heretofore and many novel features that result in a new cleaning device which is not anticipated, rendered obvious, suggested, or even implied by any of the prior art cleaning devices, either alone or in any combination thereof.

To attain this, the present invention generally comprises a cleaning device that comprises a handle member. The handle member comprises an elongated shaft that includes a first end and a second end. The handle member also includes threads positioned adjacent to the first end. The inventive device also includes plurality of heads. Each of the heads is removably coupled to the threads of the handle member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cleaning device apparatus and method which has many of the advantages of the cleaning devices mentioned heretofore and many novel features that result in a new cleaning device which is not anticipated, rendered obvious, suggested, or even implied by any of the prior art cleaning devices, either alone or in any combination thereof.

It is another object of the present invention to provide a new cleaning device which may be easily and efficiently manufactured and marketed.

It is a further object of the present invention to provide a new cleaning device which is of a durable and reliable construction.

An even further object of the present invention is to provide a new cleaning device which is susceptible of a low cost of manufacture with regard to both materials and labor, and which accordingly is then susceptible of low prices of sale to the consuming public, thereby making such cleaning device economically available to the buying public.

Still yet another object of the present invention is to provide a new cleaning device which provides in the apparatuses and methods of the prior art some of the advantages thereof, while simultaneously overcoming some of the disadvantages normally associated therewith.

Still another object of the present invention is to provide a new cleaning device for cleaning a number of hard to reach places with less difficulty.

Yet another object of the present invention is to provide a new cleaning device which includes a cleaning device that comprises a handle member. The handle member comprises an elongated shaft that includes a first end and a second end. The handle member also includes threads positioned adjacent to the first end. The inventive device also includes plurality of heads. Each of the heads is removably coupled to the threads of the handle member.

Still yet another object of the present invention is to provide a new cleaning device allows people to clean tubs, toilets and rooms without the discomfort of having to bend down.

Even still another object of the present invention is to provide a new cleaning device that allows individuals with disabilities to be able to clean their homes more easily.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
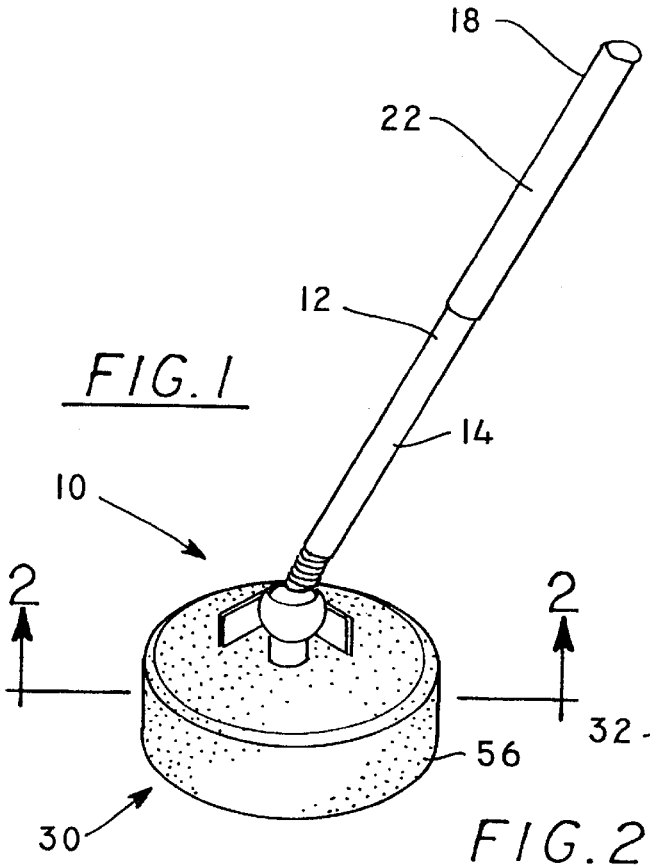
FIG. 1 is a schematic perspective view of a new cleaning device according to the present invention.
Figure 2:
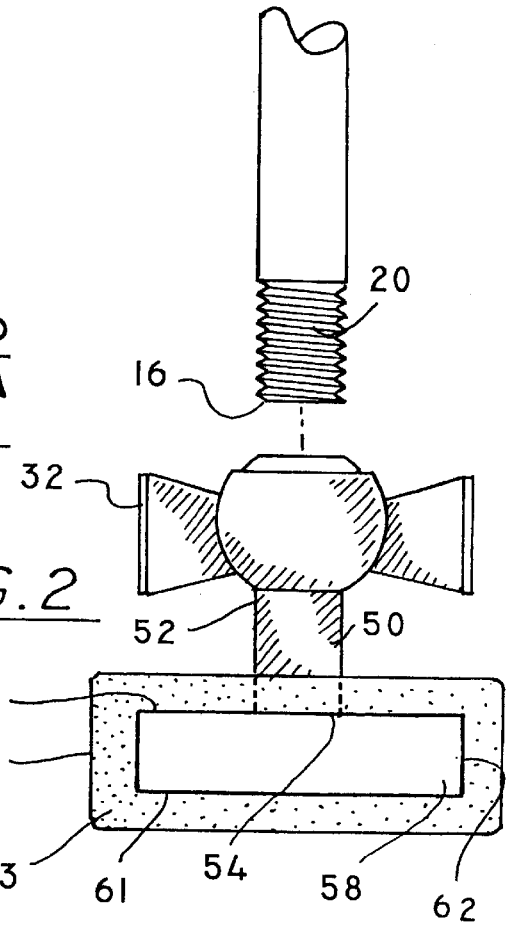
FIG. 2 is a schematic partial cross-sectional view of the present invention.
Figure 3:
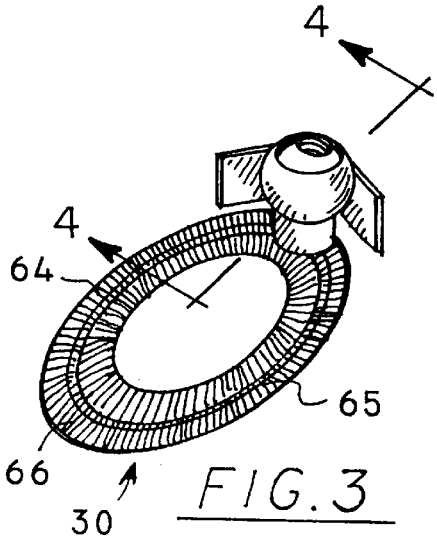
FIG. 3 is a schematic perspective view of the present invention.
Figure 4:
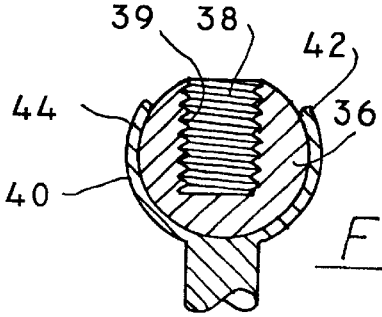
FIG. 4 is a schematic cross-sectional view of the present invention taken along line 4—4.
Figure 5:
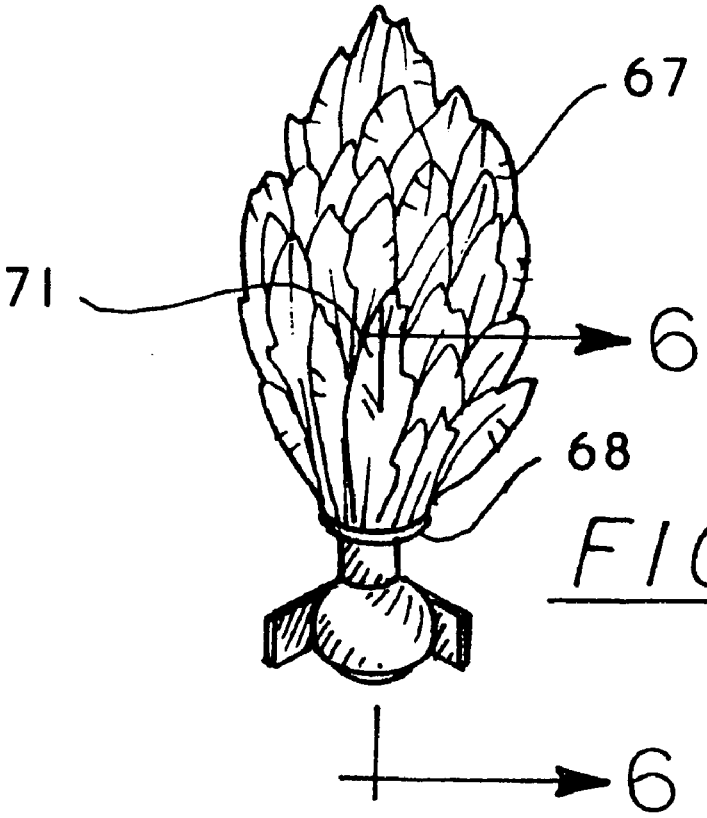
FIG. 5 is a schematic perspective view of the present invention.
Figure 6:
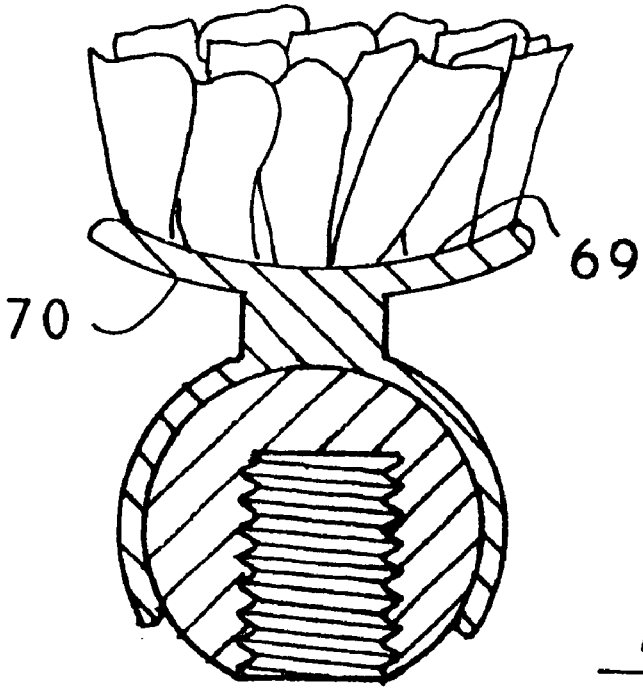
FIG. 6 is a schematic partial cross-sectional view of the present invention.

With reference now to the drawings, and in particular to FIGS. 1 through 6 thereof, a new cleaning device embodying the principles and concepts of the present invention and generally designated by the reference numeral 10 will be described.

As best illustrated in FIGS. 1 through 6, the cleaning device 10 generally comprises a cleaning device. The cleaning device is comprised of a handle member 12. The handle member 12 is comprised of an elongated shaft 14 that includes a first end 16 and a second end 18. The handle member includes threads 20 positioned generally adjacent to the first end 16. The handle member 12 may be made of any substantially rigid material such as wood, plastic or metal.

The cleaning device may also include a grip portion 22. The grip portion 22 is securably attached to the handle member 12 and positioned generally adjacent to the second end 18 of the handle member 12. The grip portion 22 has a length equal to half the length of the handle member 12. The grip portion may be comprised of a resiliently flexible material such as rubber.

To facilitate cleaning there are a plurality of heads 30. Each of the heads 30 includes a top portion 32 and a bottom portion 34 integrally coupled together. The top portion 32 is comprised of boss 36. The boss 36 includes a bore 38. The bore 36 includes a threaded inner side wall 39 such that the first end 16 of the handle member 12 may be removably extended into and coupled to the boss 36.

The top portion 32 also includes a saddle 40. The saddle 40 has a shape such that it pivotably receives the boss 36. The saddle 40 includes an open side 42 for exposing the bore 38 in the boss 36. There are a couple flanges attached to an outer surface 44 of the saddle 40. The flanges allow a user to hold on to the top portion 32 and the boss 36 in order to thread the handle member 12 into the boss 36.

A rod 50 that includes a first end 52 and a second end 54 is integrally coupled to and extends outwardly away from the outer surface 44 of the saddle member 40. The rod 50 extends away from the open side 42 of the saddle 40.

The bottom portion 34 is comprised of a plurality of cleaning members coupled to the rod 50. A first of the heads 30 includes an absorbent member 56. The absorbent member 56 is comprised of a plate 58 that includes an upper surface 60, a lower surface 61 and a peripheral edge 62.

The second end 54 of the rod 50 is integrally coupled to a central portion of the upper surface 60 of the plate 58. The plate 58 is orientated generally perpendicular to the rod 50. There is a covering portion 63 that is integrally coupled to and extends away from the plate 58. The covering portion 63 may be comprised of any absorbent material such as a sponge material. There can be a plurality of abrasive members integrally coupled to the covering portion 63.

A second of the heads 30 includes a scrubbing member 64. The scrubbing member 64 includes loop portion 65 integrally coupled to and extending away from the second end 54 of the rod 50. The loop portion 65 generally lies in a plane extending generally perpendicular to a longitudinal axis of the rod 50. There are a plurality of filaments 66 integrally coupled to and extending away from the loop portion 65. The plurality of filaments 66 are comprised of a resiliently flexible material such as nylon or plastic.

A third of the heads 30 includes a dusting member 67. The dusting member 67 includes a collar 68. The collar 68 includes a first side 69 and a second side 70. The second end 54 of the rod 50 is integrally coupled to a central portion of the second side 70 of the collar 68. A plurality of dusting members 71 is securably attached to and extending away from the first side 69 of the collar. Each of the dusting members 71 comprises a feather. Other materials may also be used such as a synthetic cloth or fabric material.

In use, each of the heads 30 is interchangeable. All the user must do is unthread one of the heads 30 from the handle member 12 and thread on a new head 30. The ability to interchange heads 30 allows users the ability to clean a wide variety of areas and things.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cleaning device comprising:

a handle member comprising an elongated shaft having a first end and a second end; and a plurality of heads, each of said heads being removably mountable on the first end of said handle member;

each of said heads comprising:

a cleaning member for cleaning a surface; and a mounting structure for mounting said cleaning member on the first end of said handle member, said mounting structure comprising a ball for removably mounting on the first end of said handle member and a socket mounted on said cleaning member, said ball being swivelly mounted in said socket for permitting swivel movement of said cleaning member with respect to said handle member.

2. The cleaning device of claim 1, further comprising:

a grip portion attached to said handle member and positioned generally adjacent to said second end of said handle member.

3. The cleaning device of claim 1, wherein said cleaning member comprises an absorbent member, said absorbent member comprising a plate, said plate having an upper surface, a lower surface and a peripheral edge, said socket of said mounting structure being coupled to a central portion of said upper surface of said plate, a covering portion being integrally coupled to and extending away from said plate.

4. The cleaning device of claim 1, wherein said cleaning member comprises a scrubbing member having a loop portion coupled to and extending away from said socket of said mounting structure, and a plurality of filaments being coupled to and extending away from said loop portion.

5. The cleaning device of claim 1, wherein said cleaning member comprises a dusting member having a collar with a first side and a second side, said socket of said mounting structure being coupled to a central portion of said second side of said collar, a plurality of dusting members being attached to and extending away from said first side of said collar member.

6. A cleaning device comprising:

a handle member comprising an elongated shaft having a first end and a second end, said handle member having threads thereon; and a plurality of heads, each of said heads being removably coupled to coupled to said threads of said handle member;

each of said heads having a top portion and a bottom portion integrally coupled together, wherein said top portion removably couples to said first end of said handle member;

wherein said top portion comprises:

a boss, said boss having a bore extending therein, said bore having a threaded inner side will such that said first end of said handle member may be removably extended into and coupled to said boss;

a saddle, said saddle for pivotably receiving said boss, said saddle having an open side for exposing said bore in said boss;

a rod, said rod having a first end and a second end, said first end of said rod being integrally coupled to and extending outwardly extending away from said open side of said saddle, said rod being integrally coupled to said bottom portion; and wherein said bottom portion comprises one of a plurality of interchangeable cleaning members.

7. The cleaning device of claim 6, wherein one of said cleaning members comprises an absorbent member, said absorbent member comprising a plate having an upper surface, a lower surface and a peripheral edge, said second end of said rod being integrally coupled to a central portion of said upper surface of said plate, said plate being oriented generally perpendicular to said rod, a covering portion being coupled to and extending away from said plate.

8. The cleaning device of claim 6, wherein one of said cleaning members comprises a scrubbing member, said scrubbing member having a loop portion, said loop portion being coupled to and extending away from said second end of said rod, and a plurality of filaments, each of said filaments being coupled to and extending away from said loop portion.

9. The cleaning device of claim 6, wherein one of said cleaning members comprises a dusting member, said dusting member having a collar with a first side and a second side, said second end of said rod being coupled to a central portion of said second side of said collar, a plurality of dusting members being attached to and extending away from said first side of said collar member.

10. The cleaning device of claim 6, further comprising a grip portion attached to said handle member and positioned generally adjacent to said second end of said handle member.

11. A cleaning device, said cleaning device comprising:

a handle member comprising an elongated shaft having a first end and a second end, said handle member having threads thereon, said threads being positioned generally adjacent to said first end;

a grip portion being attached to said handle member and positioned generally adjacent to said second end of said handle member, said grip portion having a length equal to half a length of said handle member, said grip member comprises a resiliently flexible material;

a plurality of heads, each of said heads having a top portion and a bottom portion integrally coupled together, said top portion comprising:

a boss having a bore extending therein, said bore having a threaded inner side wall such that said first end of said handle member may be removably extended into and coupled to said boss;

a saddle for pivotably receiving said boss, said saddle having an open side for exposing said bore in said boss;

a rod having a first end and a second end, said first end of said rod being integrally coupled to and extending outwardly away from an outer surface of said saddle member, said rod extending away from said open side of said saddle;

wherein said bottom portion comprises one of a plurality of interchangeable cleaning members coupled to said rod;

a first one of said plurality of heads having an absorbent member said absorbent comprising a plate, said plate having an upper surface a lower surface and a peripheral edge, said second end of said rod being integrally coupled to a central portion of said upper surface of said plate, said plate being oriented generally perpendicular to said rod, a covering portion being integrally coupled to and extending away from said plate, said covering portion comprises an absorbent material a second one of said plurality of heads having a scrubbing member, said scrubbing member having a loop portion, said loop portion being integrally coupled to and extending away from said second end of said rod, a plurality of filaments, each of said filaments being integrally coupled to and extending away from said loop portion, said plurality of filaments comprises a resiliently flexible material; and a third one of said plurality of heads having a dusting member, said dusting member having a collar, said collar having a first side and a second side, said second end of said rod being integrally coupled to a central portion of said second side of said collar, a plurality of dusting members being attached to and extending away from said first side of said collar member, each of said dusting members comprises a feather.

* * * * *